United States Patent [19]

Shida et al.

[11] Patent Number: 4,859,415

[45] Date of Patent: Aug. 22, 1989

[54] METHOD OF IMPROVING THE RESISTANCE OF TI-BASED ALLOYS TO CORROSION IN DEEP-WELL ENVIRONMENTS

[75] Inventors: Yoshiaki Shida, Ikoma; Shiro Kitayama, Kobe; Tomio Nishikawa, Takatsuki, all of Japan

[73] Assignee: Sumitomo Metal Industries, Ltd., Osaka, Japan

[21] Appl. No.: 114,016

[22] Filed: Oct. 29, 1987

[30] Foreign Application Priority Data

Oct. 31, 1986 [JP] Japan ..... 61-260150

[51] Int. Cl.[4] ..... C22C 14/00

[52] U.S. Cl. ..... 420/417; 420/418; 420/419

[58] Field of Search ..... 420/417, 418, 419

[56] References Cited

U.S. PATENT DOCUMENTS

| | | | |
|---|---|---|---|
| 3,063,835 | 11/1962 | Stern | 420/417 |
| 3,084,042 | 4/1963 | Wartel et al. | 75/221 |
| 3,880,655 | 4/1975 | Glazunov et al. | 75/175.5 |
| 4,568,398 | 2/1986 | Wood et al. | 420/417 |
| 4,666,666 | 5/1987 | Taki et al. | 420/417 |

FOREIGN PATENT DOCUMENTS

| | | | |
|---|---|---|---|
| 0975585 | 10/1975 | Canada | 420/419 |
| 0002322 | 1/1971 | Japan | 420/417 |
| 0037513 | 4/1978 | Japan | 420/417 |
| 0123322 | 10/1978 | Japan | 420/417 |
| 61-9543 | 6/1984 | Japan . | |
| 61-127843 | 11/1984 | Japan . | |
| 61-127844 | 11/1984 | Japan . | |
| 61-194142 | 2/1985 | Japan . | |
| 0221539 | 11/1985 | Japan | 420/417 |
| 1009545 | 1/1986 | Japan | 420/417 |
| 882184 | 11/1961 | United Kingdom . | |
| 911520 | 11/1962 | United Kingdom . | |
| 928407 | 6/1963 | United Kingdom . | |
| 1403206 | 8/1975 | United Kingdom . | |
| 2167769 | 6/1986 | United Kingdom . | |
| 2184455 | 6/1987 | United Kingdom . | |

*Primary Examiner*—Upendra Roy

*Attorney, Agent, or Firm*—Burns, Doane, Swecker & Mathis

[57] ABSTRACT

A method of improving the resistance of oil-well tubular products made of $\alpha$-type or $(\alpha+\beta)$-type Ti-based alloys to corrosion in a deep-well environment at high temperatures is disclosed. The method is characterized by adding, as an alloying element, (A) at least one platinum group metal in an amount of 0.02–0.20% by weight, or (B) at least one platinum group metal in an amount of 0.005–0.12% by weight and optionally at least one of Ni, Co, W, and Mo in an amount of 0.05–2.00% by weight.

21 Claims, 1 Drawing Sheet

METHOD OF IMPROVING THE RESISTANCE OF TI-BASED ALLOYS TO CORROSION IN DEEP-WELL ENVIRONMENTS

The present invention relates to a method of improving the resistance of Ti-based alloys to corrosion in the environments found in a variety of deep wells, such as deep oil-wells, gas-wells, and geothermal hot water wells (hereunder collectively referred to as "deep-wells").

Ti-based alloys have been thought to be very tough and reliable when used under corrosive conditions. Recently, the depth of wells for use in exploring for and reaching new sources of oil, gas, and geothermal energy has been continuously increasing. The environment in such deep wells is severely corrosive. In addition to high pressures and high temperatures, the environment of deep wells contains corrosive materials such as carbon dioxide and chloride ions as well as wet hydrogen sulfide under high pressure. Such an environment is hereunder referred to as a "deep-well environment". Furthermore, a deep-well environment sometimes contains elemental sulfur, making the environment even more corrosive.

Therefore, expensive, high-grade corrosion-resistant Ni-based alloys such as Hastelloy C-276 (tradename) have recently been employed in place of conventional alloy steels for oil wells. However, it has recently been reported that even the Hastelloy C-276 would be damaged in such a very severe environment as that containing elemental sulfur. In addition thereto, these materials contain Ni as a major alloying element, and Ni is not only very expensive but also the resources thereof are very limited. Thus, a stable supply of large amounts thereof will be uncertain in the future. Also, the deeper the well the lighter material is required.

Titanium, on the other hand, is readily available as an industrial metal. It is the 4th most readily available after aluminum, iron, and magnesium. Titanium was first used industrially in the aircraft industry on account of its high strength-to-weight ratio and toughness. Since it also exhibits improved resistance to corrosion, Ti-based alloys have recently come to be widely used as structural members for chemical plants, for power plants including thermal and nuclear power plants, and desalination plants.

Ti-based alloys of the $(\alpha+\beta)$ type have been tried for housings for oil-well data loggers, drill pipes, and the like. Although they are still more expensive than Ni-based alloys, Ti-based alloys have already been used widely enough to prove that $(\alpha+\beta)$ type Ti-based alloys such as Ti-6Al-4V alloys are practical as light, high-strength materials.

However, unlike high Ni-alloys $(\alpha+\beta)$-type Ti-alloys such as Ti-6Al-4V alloys have an insufficient level of resistance to severe corrosive conditions such as found in deep-well environments. It has been thought that Ti-based alloys are not comparable with high Ni-alloys in respect not only to resistance to corrosion but also to material costs.

In fact, according to experiments carried out by the inventors of the present invention, Ti-6al-4V alloys and some others exhibited poor resistance to corrosion in a deep-well environment. Corrosion resistance of an alloy much depends on environmental conditions.

Of Ti-based alloys, it has been reported that Mo-containing $\beta$-type titanium alloys such as $\beta$-C (Ti-3Al-8V-6Cr-4Mo-4Zr alloys) and a Ti-15Mo-5Zr-3Al alloy can exhibit improved resistance to corrosion in comparison with Ti-6Al-4V. It is also known that Ti-based alloys may be used for making tubular goods for oil wells. For example, several Ti-based alloys including a Ti-3Al-8V-6Cr-4Mo-4Zr alloy are also being studied currently for deep-well use. The Ti-3Al-8V-6Cr-4Mo-4Zr alloy has been reported to have excellent resistance to corrosion in an acidified sodium chloride solution containing $CO_2$ and $H_2S$ at high temperatures. However, these $\beta$-type titanium alloys have not yet been widely used as structural materials. They are very expensive and it has not yet been established whether seamless pipes can be manufactured from $\beta$-alloys. In addition, since their properties have not yet been studied thoroughly, their long-term reliability has not yet been determined. Thus, it is not clear whether $\beta$-type Ti-based alloys can be safely used for manufacturing deep-well tubular items, because these items must be reliable over an extended period of time. Furthermore, Mo-containing $\beta$-type alloys contain a relatively large amount of molybdenum, which is much more expensive than Ni. In addition, since Mo is a heavy metal, the alloying of molybdenum with Ti would impair to some extent the benefits in terms of lightness which Ti provides. It is also rather difficult to alloy molybdenum with a relatively lower-melting-point metal such as Ti. The alloying usually results in segregation of Mo during melting and solidification and there are many problems to be solved before Ti-based alloys, especially $\beta$-type Ti-based alloys having a uniform metallurgical structure, can be produced on an industrial scale.

On the other hand, it is also known that the addition of platinum group metals to pure Ti or Ti-based alloys such as a Ti-7Al-2Nb-1Ta alloy is effective to improve the resistance to corrosion in mineral acids.

Japanese Patent Application Laid-Open Specification No. 9543/1986 discloses that the addition of Ru to pure Ti is effective to improve the crevice corrosion in boiling brine.

Japanese Patent Application Laid-Open Specifications Nos. 127843/1986, 127844/1986, and 194142/1986 disclose that the addition of Ru or Pd to pure Ti, together, if necessary, with W, Mo, and Ni is effective to improve the corrosion resistance in mineral acids.

J.P. Publication No. 6053/1958 discloses a ternary Ti-based alloy containing at least two of the platinum group metals, which exhibits improved resistance to corrosion in mineral acids.

"CORROSION-NACE" Vol. 31, No. 6, June 1975 discloses the effect of addition of palladium as an alloying element on the environmental cracking resistance of Ti-7Al-2Nb-1Ta alloys in dilute mineral acids.

SUMMARY OF THE INVENTION

One of the objects of the present invention is to provide a method of improving the corrosion resistance of tubular goods for oil wells in deep-well environments.

Another object of the present invention is to provide a method of improving the resistance of Ti-based alloys, especially $\alpha$-type or $(\alpha+\beta)$-type Ti-based alloys, to corrosion in deep-well environments.

Still another object of the present invention is to provide a method of improving the resistance of Ti-based alloys, especially $\alpha$-type or $(\alpha+\beta)$-type Ti-based alloys, to corrosion in a deep-well environment containing elemental sulfur.

The inventors of the present invention have found that (1) α-type or (α+β)-type Ti-based alloys are readily available on an industrial scale and are reliable materials for use in manufacturing tubular goods for oil wells, such as casings and tubing; (2) the addition of a small amount of a platinum group metal, i.e., Pd, Ru, Os, Ir, and Pt to such high-strength Ti-based alloys can markedly improve the resistance thereof to corrosion in a deep-well environment; (3) an additional incorporation of at least one of Ni, Co, W, and Mo can further improve the corrosion resistance; (4) such improvement in the corrosion resistance can be achieved without adversely affecting the mechanical properties, including the strength, of these alloys after heat treatment; and (5) by addition of the elements listed in (2) and (3), it is for the first time possible to obtain a reliable and practical material which can exhibit markedly improved resistance to severe corrosion in a deep-well environment containing elemental sulfur.

Thus, the present invention resides in a method of improving the resistance of α-type or (α+β)-type Ti-based alloys to corrosion in deep-well environments, characterized by adding as an alloying element at least one of the platinum group metals in an amount of 0.02–0.20% by weight.

In one preferred embodiment of the present invention, the method of improving the resistance of α-type or (α+β)-type Ti-based alloys to corrosion in deep-well environments is characterized by adding as an alloying element at least one of the platinum group metals in an amount of 0.005–0.12% by weight, and at least one of Ni, Co, W, and Mo in a total amount of 0.05–2.00% by weight.

In another aspect, the present invention resides in a method of improving the resistance of oil-well tubular products made of α-type or (α+β)-type Ti-based alloys to corrosion in a deep-well environment at high temperatures, characterized by adding, as an alloying element, (A) at least one platinum group metal in an amount of 0.02–0.20% by weight, or (B) at least one platinum group metal in an amount of 0.005–0.12% by weight and at least one of Ni, Co, W, and Mo in an amount of 0.05–2.00% by weight.

The tubular product for oil well includes tubing, casing, drill pipes, housings for oil-well loggers, and the like.

The platinum group metals are preferably selected from the group consisting of Pd and Ru.

In a more preferred embodiment the platinum group metal is Pd.

Regarding the additives Ni, Co, W, and Mo, at least one of Ni and Co may be added in an amount of 0.05–2.00% by weight. Alternatively, at least one of W and Mo may be added in an amount of 0.05–2.00% by weight.

In another preferred embodiment, the Ti-based alloy is of the (α+β) type, including Ti-6Al-4V, Ti-6Al-2Sn-4Zr-2Mo, and Ti-6Al-2Sn-4Zr-6Mo.

A mechanism by which Ti-based alloys can exhibit improved corrosion resistance in accordance with the present invention in deep-well environments containing elemental sulfur can be described as follows.

The deep-well environment mentioned above is extremely corrosive since the temperature is very high ( e.g., 250°–300° C.) and the pH is approximately 2.5. In such a highly corrosive environment, commercial Ti-based alloys exhibit a corrosion potential of −150 to −250 mV (vs SHE) with respect to an inner reference electrode, and the corrosion potential sometimes intermittently drops to −400 mV (vs SHE). The fact that the corrosion potential of a Ti-based alloy drops to −400 mV (vs SHE) means that the $TiO_2$ film formed on the surface of the alloy is dissolved locally and partly in accordance with the following equations:

Anodic Reaction:

$$Ti \rightarrow Ti^{2+} + 2e^- \quad \text{(i)}$$

Cathode Reaction:

$$2H^+ + S + 2e^- \rightarrow H_2S \quad \text{(ii)}$$

The $TiO_2$ film which is formed on the surface of α-type and (α+β)-type titanium alloys is not stable in the presence of $H_2S$ and $Cl^-$ ions under acidified conditions, although usually the film is effective as a passive film. Therefore, in a severe corrosive environment in the presence of $H_2S$, such as in deep wells and geothermal hot water deep wells, the α-type and (α+β)-type alloys are easily corroded. Furthermore, when elemental sulfur is included therein, a large amount of elemental sulfur is deposited on the surface of the alloy in addition to the sulfur which is deposited in accordance with the reverse reaction of Reaction (ii). The thus-deposited sulfur easily causes corrosion underneath, which further accelerates the corrosion of the α-type and (α+β) type Ti-based alloys.

(1) The inventors of the present invention have noticed that the addition of the platinum group metals to Ti-based alloys is effective to promote Reaction (ii), rendering high the corrosion potential of the Ti-based alloy.

According to the present invention, Ti-based alloys containing platinum group metals exhibit a corrosion potential of −120 to −170 mV (vs SHE) in a simulated deep-well environment, as described hereinafter in working examples.

It is known that the addition of platinum group metals to a Ti-based alloy markedly improves the corrosion resistance in non-oxidizing acids, such as hydrochloric acid and sulfuric acid. Such an improvement in the acid corrosion resistance can be described on the basis of the following cathodic reaction;

$$2H^+ + 2e^- \rightarrow H_2 \quad \text{(iii)}$$

That is, by adding the platinum group metals the hydrogen overvoltage is decreased, as is apparent from Reaction (iii), moving the potential of the Ti-based alloy in a noble direction. Thus, the corrosion resistance in mineral acids is markedly improved.

However, it is to be noted that in a deep-well environment, the corrosion is controlled by Reaction (ii), since the equilibrium potential of Reaction (ii) is higher than that of Reaction (iii). Also, in an $H_2S$-containing environment, metal sulfides may form on the surface of a Ti-based alloy. Electrochemical reactions depend upon the surface condition of a material. Therefore, corrosive reactions in an $H_2S$-containing environment may largely deviate from those in mineral acids due mainly to metal sulfide formation. The effectiveness of additive elements can therefore be determined only by experiment. Thus, after extensive experiments, the inventors of the present invention have found that the addition of the platinum group metals decreases the over potential of Reaction (ii), and stabilizes the passive state of titanium alloys.

This effect of platinum group metals can be maintained even in the sulfur-depositing environment. In such an environment, high concentrated $H_2S$ is also included. Such high concentrated $H_2S$ deteriorates a $TiO_2$ film very aggressively. However, in the presence of Pt group metals, reformation of $TiO_2$ is attained, probably due to the stabilizing action of the Pt group metals.

Therefore, the addition of the platinum group metals to a Ti-based alloy makes the corrosion potential high so that the $TiO_2$ film on the surface of the alloy becomes more stable with an accompanying improvement in the corrosion resistance. In addition, during corrosion reactions taking place in a state of equilibrium, the platinum group metals which are added concentrate on the surface of the alloy, rendering the surface more resistant to corrosion even if crevices are formed on the surface of the alloy under the deposited sulfur. Thus, the inventors of the present invention also found that the addition of the platinum group metals is effective to improve the resistance to under deposit corrosion in the presence of precipitated sulfur.

(2) When at least one of Ni and Co is added to a Ti-based alloy together with a platinum group metal, the overvoltage of Reaction (ii) decreases, resulting in an increase in the corrosion potential of the Ti-based alloy, so that the $TiO_2$ film becomes more stable. The effectiveness of the addition of Ni and/or Co is rather small in comparison with that of the platinum group metals. However, the addition of Ni and/or Co together with the platinum group metals remarkably improves the corrosion resistance in a deep-well environment containing $H_2S$. Ni and Co form respective sulfides in oil-well environments and they will not be any more effective to reduce over potential, although these elements act as an over potential-reducer in mineral acids. The effectiveness of Ni and Co in oil-well environments is totally different from that in a mineral acid environment. Thus, the presence of Ni or Co makes the Pt group metals more effective to improve the corrosion resistance in oil-well environments.

(3) The improvement in the corrosion resistance to be derived from the addition of W and/or Mo can be described as follows.

The mere addition of Mo or W alone cannot necessarily improve corrosion resistance. A very high concentration of either element would be necessary to obtain improved corrosion resistance. It was found by experiment that Mo and W act as a support to encourage the film-stabilizing action of Pt group elements in sour oil well environments containing $H_2S$ and S. When Mo and W are dissolved, they form $MoO_4^{2-}$ or $WO_4^{2-}$ ions which cause the surface oxidation-reduction potential to move in a noble direction. This action helps to maintain corrosion resistance of the Ti alloys of the present invention even if the content of Pt group elements is relatively small.

W is as effective as Mo for producing the above effects. The addition of W forms a passive film of $WO_3$ on the surface of the alloy and the formation of a $WO_4^{2-}$-containing adsorptive layer strengthens the corrosion resistance of the Ti-based alloys.

As is described herein before, the presence of $H_2S$ and $Cl^-$ ions at high temperatures is very important and crucial to the resistance of an alloy to corrosion in oil-well environments. In addition, in such corrosive conditions the passive film of $TiO_2$ is deteriorated due to the presence of sulfides and oxides which are formed through electrochemical reactions on the surface of the alloy. On the other hand, in mineral acid environments no sulfides are formed, and there is no need to consider the influence of sulfides on corrosion resistance. It cannot be said that a passive film which can withstand mineral acids can also withstand oil-well environments containing $H_2S$. Furthermore, it cannot be said whether a passive film can withstand oil-well environments containing elemental sulfur in addition to $H_2S$ and $Cl^-$, even if it could withstand the oil-well environment which contains $H_2S$ and $Cl^-$.

Thus, from a theoretical viewpoint, too, the corrosion behavior of a Ti-based alloy in mineral acids is totally different from that in a deep-well environment, especially one containing elemental sulfur.

BRIEF DESCRIPTION OF THE DRAWINGS

FIG. 1(*b*) is a front view of the same specimen; and

DESCRIPTION OF THE PREFERRED EMBODIMENTS

Figure 1:
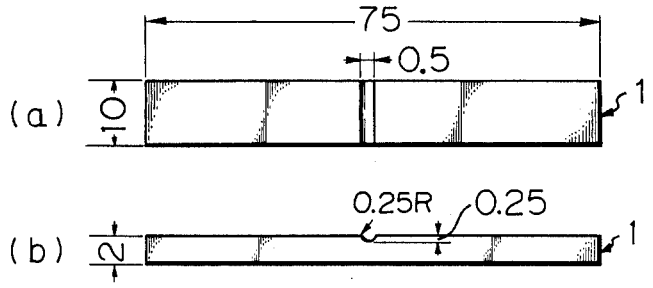
FIG. 1(*a*) is a plan view of a test specimen of an alloy prepared in accordance with the present invention.

The reasons why the above-listed additives are employed and the reasons for the restriction on the amounts thereof which are added will be now described in more detail. (a) Platinum Group Metals (Pd, Ru, Rh, Os, Ir, and Pt):

The addition of at least one of these elements is effective to prevent the general corrosion in an environment in an oil well which contains concentrated $H_2S$, $CO_2$, and $Cl^-$ at high temperatures, i.e. a deep-well environment. The effectiveness of their addition is significant when at least one of them is added in a total amount of 0.02% by weight or more even if Ni, Co, W, or Mo is not added. The resistance to corrosion in the above-mentioned environment is strengthened increasingly as the amount which is incorporated increases. However, when the total amount thereof is over 0.20% by weight, the effectiveness is saturated, resulting merely in an increase in material costs. Thus, according to the present invention, the total content of the platinum group metals, when Ni, Co, W, and Mo are not added, is restricted to 0.02–0.20% by weight. Preferably, it is 0.05–0.15% by weight.

On the other hand, when at least one of Ni, Co, W, and Mo is added together with one or more platinum group metals, the total amount of the platinum group metals can be smaller to further improve the economy of the present invention. In the case of dual addition, when the total amount of the platinum group metals is 0.005% or more by weight, its addition is effective. However, when over 0.12% by weight is added, there is no substantial additional improvement and material costs are increased. Thus, when combined together with at least one of Ni, Co, W, and Mo, a total amount of 0.005–0.12% by weight, and preferably 0.02–0.07% by weight of at least one of the platinum group metals is added in the present invention.

Among the six metals which constitute the platinum group metals, Pd, Pt and Rh are preferred to Os, Ir, and Ru so far as effectiveness in preventing corrosion in a deep-well environment is concerned. When added in the same amount, the first three elements provide more resistance to corrosion than do the latter three. While the prices of these elements undergo frequent and large fluctuations, from the standpoint of economy, Pd is generally preferable to Pt and Rh, while Ru is generally preferable to Os and Ir. In the light of these facts, it is advisable to use Pd as the platinum group metal in the present invention.

(b) Ni, Co, W, and Mo:

The addition of at least one of Ni, Co, W, and Mo together with the platinum group metals is effective to markedly improve the corrosion resistance in a deep-well environment, i.e. an environment containing concentrated $H_2S$, $Co_2$, and $Cl^-$ at high temperatures. For this purpose, if added, the total amount of these elements must be 0.05% or more by weight. However, when the amount added is over 2.00% by weight, there is no substantial additional improvement in the corrosion resistance. Thus, according to the present invention, at least one of Ni, Co, W, and Mo may be added in a total amount of 0.05–2.00% by weight. More specifically, as herein before mentioned, at least one of Ni and Co may be added in a total amount of 0.05–2.00% by weight. Furthermore, at least one of W and Mo may be added with or without Ni or Co in a total amount of 0.05–2.00% by weight. Although Mo and W are generally equivalent to each other, Mo is less effective than W. Therefore, if employed, Mo should be added in a somewhat large amount. Needless to say, if the basic alloy system to which the above additives are to be added in accordance with the present invention contains Mo, there is no need to add additional Mo.

The present invention will be further described in conjunction with some working examples, which are presented merely as illustrations of the present invention, and are in no way restrictive.

EXAMPLES

One lot of conventional Ti-based alloys was prepared. To some of the samples in the lot a small amount of one or more platinum group metals or a small amount of one or more platinum group metals together with at least one of Ni, Co, W, and Mo were added to prepare small square ingots (400 g each) using the button-melting method.

In the button-melting method, chips of various types of conventional Ti-based alloys were combined with the platinum group metal powder together with, if necessary, a metal powder selected from Ni, Co, W, and Mo. The resulting powder mixtures were melted by an argon-arc melting method to obtain five small, round ingots of 80 g each. Using some of these small ingots, square ingots measuring 10 mm in thickness × 100 mm in width × 100 mm in length were prepared through remelting and casting.

The alloy compositions of the thus obtained series of Ti-based alloys are shown in Table 1.

The resulting Ti-based alloys were then subjected to hot forging and hot rolling to a thickness of 4 mm. Different types of heat treatments were applied to the steel test plates as summarized in Table 2.

The resulting specimens, each having a small notch, were subjected to a four-point bending test. The dimensions of the specimens were 2 mm thick × 10 mm wide × 75 mm long with a central notch having a radius R of 0.25 mm and a depth of 0.25 mm. FIG. 1 (*a*) is a plan view of one of the specimens 1 and FIG. (*b*) is a front view thereof.

Figure 2:
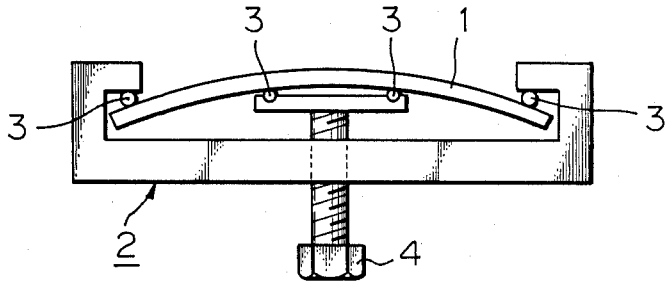
FIG. 2 is a schematic view of a four-point beam-type jig which was used to carry out corrosion tests on specimens like the one drawn in FIG. 1.

Bending tests were then carried out in the manner shown in FIG. 2. Each specimen 1 was held by a four-point beam-type jig 2 and a bending force corresponding to the yield stress (0.2% off-set) was applied thereto. The specimens were subjected to three types of corrosion test conditions in an autoclave (capacity of 10 l) to determine the occurrence of cracks and the rate of corrosion. In FIG. 2, reference numeral 3 indicates a round glass rod, reference numeral 4 indicates bolts for applying stress to the specimen. First Corrosion Test Conditions:

Solution Temperature: 250° C.
Solution Composition:
20% NaCl-0.5% $CH_3COOH$-aqueous solution
Partial Gas Pressures in the Gas Phase:
10 kgf/cm$^2$ $H_2S$, 10 kgf/cm$^2$ $CO_2$
Test Duration: 336 hours
Second Corrosion Test Conditions:
Solution Temperature: 300° C.
Solution Composition:
20% NaCl-0.5% $CH_3COOH$-aqueous solution
Partial Gas Pressures in the Gas Phase:
10 kgf/cm$^2$ $H_2S$, 10 kgf/cm$^2$ $CO_2$
Test Duration: 336 hours
Third Corrosion Test Conditions:
Solution Temperature: 250° C.
Solution Composition:
20% NaCl-0.5% $CH_3COOH$-1 g/l S -aqueous solution
Partial Gas Pressures in the Gas Phase:
10 kgf/cm$^2$ $H_2S$, 10 kgf/cm$^2$ $CO_2$
Test Duration: 336 hours Another series of flat test pieces (Parallel portion: 2 mm thick × 6.25 mm wide × 25 mm long) was prepared by cutting the above-described steel test plates in the widthwise direction, and the mechanical properties of the test pieces were determined at room temperature.

For comparative purposes, not only Ti-based alloys, but also Hastelloy C-276 (tradename) and Inconel X-750 (tradename), which are typical high-nickel alloys, were tested in the same manner.

The test results are shown in Table 3, in which the general corrosion rate (mm/year) was calculated on the basis of the weight loss during testing.

Referring to Comparative Examples Nos. 84 and 85 using Hastelloy C-276 and Inconel X-750, respectively, it is noted that a high-Ni alloy like Hastelloy C-276 can exhibit improved resistance at 250° C., but the corrosion rate increases at 300° C. Furthermore, fatal cracks occur for a high-Ni alloy like Inconel X-750 which does not contain Mo and its weight loss is very large.

In contrast, all the Ti-based alloys which were tested, including the comparative Ti-based alloys, were free from cracking. However, the corrosion rate was very high for all the comparative Ti-based alloys. In particular, in Comparative Examples 1 and 2 in which the content of the platinum group metals was small, and in Comparative Example 20 and Comparative Example 26 in which the Ni content was small and the content of the platinum group metal was rather small, the weight loss was relatively large. Furthermore, in Comparative Examples 35, 36, and 37 in which the platinum group metals were not included, the alloys exhibited poor corrosion resistance, although a relatively large amount of Ni, W, or Mo was added. Particularly, when Ni alone was added, the weight loss was large.

However, Ti-based alloys prepared in accordance with the present invention exhibit a satisfactory level of corrosion resistance in an environment similar to a deep-well environment, especially to a deep well environment containing elemental sulfur. It is also to be noted that the Ti-based alloys of the present invention have the same level of mechanical properties as conventional Ti-based alloys. This is very important since conventional Ti-based alloys have been well established as construction materials. Therefore, the present invention can provide construction materials of high reliability.

Thus, the present invention offers the following advantages:

(a) Alloys which can maintain markedly improved resistance to corrosion in severe sour oil wells such as recently developed deep wells can be produced.

(b) The amount of additives is very small, and substantially the same mechanical and heat treatment properties as for conventional Ti-based alloys are retained after incorporation of these additives. Therefore, a much of the large boy of knowledge concerning conventional Ti-based alloys can be utilized, whereby practical and reliable materials can be obtained.

(c) Material costs are not remarkably greater than for conventional Ti-based alloys since the amount of the additives is very small. Specifically, when Ni, Co, W, or Mo is added in combination with one or more platinum group metals, the increase in the material costs is extremely small.

(d) Since Ti-based alloys can exhibit excellent resistance to corrosion in an oxidizing environment, the alloys of the present invention are very advantageous in comparison with high-Ni alloys when they are used in an area where corrosive conditions could easily change to oxidizing ones due to possible leakage of oxygen gas ($O_2$). These conditions are more frequently found in geothermal hot water wells than in oil wells. Thus, the Ti-based alloys of the present invention can resist more severe corrosive conditions than high-Ni alloys.

(e) Like conventional Ti-based alloys, the Ti-based alloys of the present invention can also exhibit excellent resistance to general corrosion in acids and crevice corrosion.

Thus, according to the present invention, it is possible to further extend the life span of the deep wells even in a severely corrosive environment.

TABLE 1

| | | Chemical composition (% by weight) | | | | | | | | | | | | | | | | |
|---|---|---|---|---|---|---|---|---|---|---|---|---|---|---|---|---|---|---|
| | | | | | | | | Platinum Group Metals | | | | | | | | | | Ti and Incidental |
| Alloy No. | | Al | V | Sn | Zr | Nb | Ta | Pd | Ru | Rh | Os | Ir | Pt | Ni | Co | W | Mo | Impurities |
| Comparative Alloys | 1 | 6.48 | 4.15 | — | — | — | — | — | — | — | — | — | — | — | — | — | — | bal. |
| | 2 | 6.47 | 4.16 | — | — | — | — | 0.006 | — | — | — | — | — | — | — | — | — | bal. |
| Invention Alloys | 3 | 6.49 | 4.16 | — | — | — | — | 0.01 | — | — | — | — | — | — | — | — | — | bal. |
| | 4 | 6.48 | 4.14 | — | — | — | — | 0.03 | — | — | — | — | — | — | — | — | — | bal. |
| | 5 | 6.49 | 4.15 | — | — | — | — | 0.06 | — | — | — | — | — | — | — | — | — | bal. |
| | 6 | 6.47 | 4.14 | — | — | — | — | 0.11 | — | — | — | — | — | — | — | — | — | bal. |
| | 7 | 6.49 | 4.16 | — | — | — | — | 0.14 | — | — | — | — | — | — | — | — | — | bal. |
| | 8 | 6.48 | 4.15 | — | — | — | — | 0.19 | — | — | — | — | — | — | — | — | — | bal. |
| Comparative Alloys | 9 | 6.47 | 4.16 | — | — | — | — | — | 0.01 | — | — | — | — | — | — | — | — | bal. |
| Invention Alloys | 10 | 6.47 | 4.15 | — | — | — | — | — | 0.05 | — | — | — | — | — | — | — | — | bal. |
| | 11 | 6.49 | 4.16 | — | — | — | — | — | 0.09 | — | — | — | — | — | — | — | — | bal. |
| | 12 | 6.47 | 4.14 | — | — | — | — | — | 0.14 | — | — | — | — | — | — | — | — | bal. |
| | 13 | 6.46 | 4.17 | — | — | — | — | 0.05 | 0.02 | — | — | — | — | — | — | — | — | bal. |
| | 14 | 6.48 | 4.15 | — | — | — | — | 0.05 | — | 0.01 | — | — | 0.02 | — | — | — | — | bal. |
| Comparative Alloys | 15 | 6.46 | 4.14 | — | — | — | — | — | — | — | 0.01 | — | — | — | — | — | — | bal. |
| Invention Alloys | 16 | 6.48 | 4.16 | — | — | — | — | — | — | — | 0.06 | — | — | — | — | — | — | bal. |
| Comparative Alloys | 17 | 6.47 | 4.15 | — | — | — | — | — | — | — | — | 0.01 | — | — | — | — | — | bal. |
| Invention Alloys | 18 | 6.48 | 4.14 | — | — | — | — | — | — | — | — | 0.06 | — | — | — | — | — | bal. |
| | 19 | 6.49 | 4.15 | — | — | — | — | — | — | 0.06 | — | — | 0.05 | — | — | — | — | bal. |
| Comparative Alloys | 20 | 6.49 | 4.14 | — | — | — | — | 0.002 | — | — | — | — | — | 0.41 | — | — | — | bal. |
| Invention Alloys | 21 | 6.49 | 4.15 | — | — | — | — | 0.008 | — | — | — | — | — | 0.48 | — | — | — | bal. |
| Comparative Alloys | 22 | 6.47 | 4.16 | — | — | — | — | 0.004 | — | — | — | — | — | — | 0.04 | — | — | bal. |
| Invention Alloys | 23 | 6.48 | 4.14 | — | — | — | — | 0.02 | — | — | — | — | — | — | 0.31 | — | — | bal. |
| | 24 | 6.49 | 4.16 | — | — | — | — | 0.03 | — | — | — | — | — | 0.10 | — | — | — | bal. |
| | 25 | 6.45 | 4.13 | — | — | — | — | 0.03 | — | — | — | — | — | — | — | — | 1.81 | bal. |
| Comparative Alloys | 26 | 6.48 | 4.16 | — | — | — | — | 0.01 | — | — | — | — | — | 0.03 | — | — | — | bal. |
| | 27 | 6.46 | 4.14 | — | — | — | — | 0.01 | — | — | — | — | — | — | — | 0.04 | — | bal. |
| Invention Alloys | 28 | 6.47 | 4.15 | — | — | — | — | 0.03 | — | — | — | — | — | — | — | 0.51 | — | bal. |
| Comparative Alloys | 29 | 6.45 | 4.16 | — | — | — | — | 0.01 | — | — | — | — | — | — | — | — | 0.04 | bal. |
| Invention Alloys | 30 | 6.46 | 4.17 | — | — | — | — | 0.03 | — | — | — | — | — | 0.25 | — | — | 0.30 | bal. |
| | 31 | 6.47 | 4.15 | — | — | — | — | 0.03 | — | — | — | — | — | — | 0.35 | 0.31 | — | bal. |
| | 32 | 6.48 | 4.15 | — | — | — | — | 0.03 | — | — | — | — | — | 0.33 | — | 0.35 | — | bal. |
| | 33 | 6.48 | 4.15 | — | — | — | — | 0.03 | — | — | — | — | — | — | 0.38 | — | 0.40 | bal. |

TABLE 1-continued

| Alloy No. | | Chemical composition (% by weight) | | | | | | | | | | | | | | | | |
|---|---|---|---|---|---|---|---|---|---|---|---|---|---|---|---|---|---|---|
| | | | | | | | | Platinum Group Metals | | | | | | | | | | Ti and Incidental |
| | | Al | V | Sn | Zr | Nb | Ta | Pd | Ru | Rh | Os | Ir | Pt | Ni | Co | W | Mo | Impurities |
| | 34 | 6.47 | 4.16 | — | — | — | — | 0.04 | — | — | — | — | — | — | — | 0.50 | 0.38 | bal. |
| Compar- | 35 | 6.48 | 4.15 | — | — | — | — | — | — | — | — | — | — | 0.95 | — | — | — | bal. |
| ative | 36 | 6.47 | 4.16 | — | — | — | — | — | — | — | — | — | — | — | — | — | 1.74 | bal. |
| Alloys | 37 | 6.49 | 4.17 | — | — | — | — | — | — | — | — | — | — | — | — | 1.58 | — | bal. |
| Invention | 38 | 6.48 | 4.15 | — | — | — | — | 0.05 | — | — | — | — | — | 0.31 | — | — | — | bal. |
| Alloys | 39 | 6.47 | 4.14 | — | — | — | — | 0.07 | — | — | — | — | — | 0.28 | — | — | 0.33 | bal. |
| | 40 | 6.46 | 4.14 | — | — | — | — | 0.12 | — | — | — | — | — | 0.27 | — | 0.25 | — | bal. |
| | 41 | 6.48 | 4.16 | — | — | — | — | — | 0.05 | — | — | — | — | 0.41 | — | — | — | bal. |
| | 42 | 6.47 | 4.15 | — | — | — | — | — | 0.09 | — | — | — | — | — | 0.49 | — | — | bal. |
| | 43 | 6.47 | 4.17 | — | — | — | — | 0.03 | 0.04 | 0.01 | — | — | — | 0.31 | — | — | — | bal. |
| | 44 | 6.48 | 4.16 | — | — | — | — | 0.02 | — | — | 0.01 | 0.02 | — | 0.24 | — | — | — | bal. |
| | 45 | 6.49 | 4.17 | — | — | — | — | 0.03 | — | — | — | — | 0.04 | 0.22 | — | — | — | bal. |
| | 46 | 6.48 | 4.15 | — | — | — | — | — | — | 0.05 | — | — | — | 0.29 | — | — | — | bal. |
| | 47 | 6.47 | 4.14 | — | — | — | — | — | — | — | 0.05 | — | — | 0.38 | — | — | — | bal. |
| | 48 | 6.48 | 4.16 | — | — | — | — | — | — | — | — | 0.06 | — | 0.39 | — | — | — | bal. |
| | 49 | 6.40 | 4.15 | — | — | — | — | — | — | — | — | — | 0.03 | 0.41 | — | — | — | bal. |
| Compar- | 50 | 6.03 | 6.05 | 2.00 | — | — | — | — | — | — | — | — | — | — | — | — | — | bal. |
| ative | | | | | | | | | | | | | | | | | | |
| Alloys | | | | | | | | | | | | | | | | | | |
| Invention | 51 | 5.98 | 6.01 | 1.98 | — | — | — | 0.03 | — | — | — | — | — | — | — | — | — | bal. |
| Alloys | 52 | 5.99 | 6.00 | 2.01 | — | — | — | 0.06 | — | — | — | — | — | — | — | — | — | bal. |
| | 53 | 5.97 | 5.97 | 2.00 | — | — | — | 0.15 | — | — | — | — | — | — | — | — | — | bal. |
| | 54 | 5.99 | 6.00 | 2.02 | — | — | — | 0.03 | — | — | — | — | — | 0.33 | — | — | — | bal. |
| | 55 | 5.99 | 6.02 | 2.01 | — | — | — | 0.03 | — | — | — | — | — | — | 0.35 | — | — | bal. |
| | 56 | 6.05 | 6.01 | 2.02 | — | — | — | 0.03 | — | — | — | — | — | — | — | 0.44 | — | bal. |
| | 57 | 6.06 | 6.03 | 1.99 | — | — | — | — | 0.05 | — | — | — | — | 0.41 | — | — | — | bal. |
| Compar- | 58 | 3.03 | 2.58 | — | — | — | — | — | — | — | — | — | — | — | — | — | — | bal. |
| ative | | | | | | | | | | | | | | | | | | |
| Alloys | | | | | | | | | | | | | | | | | | |
| Invention | 59 | 3.04 | 2.59 | — | — | — | — | 0.06 | — | — | — | — | — | — | — | — | — | bal. |
| Alloys | 60 | 3.05 | 2.63 | — | — | — | — | 0.03 | — | — | — | — | — | 0.31 | — | — | — | bal. |
| | 61 | 3.06 | 2.61 | — | — | — | — | 0.03 | — | — | — | — | — | 0.29 | — | — | 0.22 | bal. |
| Compar- | 62 | 6.01 | — | 2.00 | 4.05 | — | — | — | — | — | — | — | — | — | — | — | 6.12 | bal. |
| ative | | | | | | | | | | | | | | | | | | |
| Alloys | | | | | | | | | | | | | | | | | | |
| Invention | 63 | 5.98 | — | 1.98 | 4.06 | — | — | 0.05 | — | — | — | — | — | — | — | — | 6.15 | bal. |
| Alloys | 64 | 5.99 | — | 1.99 | 4.03 | — | — | 0.03 | — | — | — | — | — | 0.35 | — | — | 6.18 | bal. |
| | 65 | 6.00 | — | 2.02 | 4.06 | — | — | 0.04 | — | — | — | — | — | 0.34 | — | 0.32 | 6.13 | bal. |
| | 66 | 6.02 | — | 2.00 | 4.04 | — | — | 0.03 | — | — | — | — | — | — | 0.41 | — | 6.15 | bal. |
| | 67 | 6.03 | — | 2.03 | 4.07 | — | — | — | 0.05 | — | — | — | — | 0.35 | — | — | 6.17 | bal. |
| Compar- | 68 | 6.95 | — | — | — | — | — | — | — | — | — | — | — | — | — | — | 4.03 | bal. |
| ative | | | | | | | | | | | | | | | | | | |
| Alloys | | | | | | | | | | | | | | | | | | |
| Invention | 69 | 6.93 | — | — | — | — | — | 0.03 | — | — | — | — | — | 0.35 | — | — | 4.07 | bal. |
| Alloys | 70 | 6.91 | — | — | — | — | — | 0.07 | — | — | — | — | — | — | — | — | 4.05 | bal. |
| Compar- | 71 | 7.80 | 1.10 | — | — | — | — | — | — | — | — | — | — | — | — | — | 1.08 | bal. |
| ative | | | | | | | | | | | | | | | | | | |
| Alloys | | | | | | | | | | | | | | | | | | |
| Invention | 72 | 7.83 | 1.07 | — | — | — | — | 0.03 | — | — | — | — | — | 0.38 | — | — | 1.09 | bal. |
| Alloys | 73 | 7.84 | 1.08 | — | — | — | — | 0.08 | — | — | — | — | — | — | — | — | 1.08 | bal. |
| Compar- | 74 | 6.01 | — | 2.02 | 4.03 | — | — | — | — | — | — | — | — | — | — | — | 2.05 | bal. |
| ative | | | | | | | | | | | | | | | | | | |
| Alloys | | | | | | | | | | | | | | | | | | |
| Invention | 75 | 5.99 | — | 2.03 | 4.01 | — | — | 0.03 | — | — | — | — | — | 0.38 | — | — | 2.06 | bal. |
| Alloys | 76 | 5.98 | — | 1.99 | 3.99 | — | — | 0.07 | — | — | — | — | — | — | — | — | 2.02 | bal. |
| | 77 | 6.02 | — | 2.01 | 4.03 | — | — | — | 0.05 | — | — | — | — | 0.49 | — | — | 2.07 | bal. |
| Compar- | 78 | 6.01 | — | — | — | 2.03 | 1.05 | — | — | — | — | — | — | — | — | — | 1.09 | bal. |
| ative | | | | | | | | | | | | | | | | | | |
| Alloys | | | | | | | | | | | | | | | | | | |
| Invention | 79 | 5.98 | — | — | — | 2.00 | 1.01 | 0.03 | — | — | — | — | — | 0.38 | — | — | 1.12 | bal. |
| Alloys | 80 | 5.99 | — | — | — | 2.05 | 1.03 | 0.06 | — | — | — | — | — | — | — | — | 1.09 | bal. |
| Compar- | 81 | 5.35 | — | 2.58 | — | — | — | — | — | — | — | — | — | — | — | — | — | bal. |
| ative | | | | | | | | | | | | | | | | | | |
| Alloys | | | | | | | | | | | | | | | | | | |
| Invention | 82 | 5.38 | — | 2.59 | — | — | — | 0.03 | — | — | — | — | — | 0.43 | — | — | — | bal. |
| Alloys | 83 | 5.36 | — | 2.60 | — | — | — | 0.08 | — | — | — | — | — | — | — | — | — | bal. |
| Compar- | 84 | Hastelloy C-276 (Tradename) (Ni—15.4Cr—14.2Mo—3.4W—2.2Co—5.6Fe—0.2V—0.5Mn—0.04Si—0.01C) | | | | | | | | | | | | | | | | |
| ative | 85 | Inconel X750 (Tradename) (Ni—15.1Cr—7.0Fe—2.4Ti—0.68Al—0.51Nb—0.23Ta—0.6Mn—0.22Si—0.02C) | | | | | | | | | | | | | | | | |
| Alloys | | | | | | | | | | | | | | | | | | |

TABLE 2

| Alloy System (Alloy No. of Table 1) | Heat Treatment |
|---|---|
| Ti—6Al—4V (1~49) | 705° C. × 30 min. → air cooling |
| Ti—6Al—6V—2Sn (50~57) | 760° C. × 30 min. → air cooling |
| Ti—3Al—2.5V (58~61) | 700° C. × 30 min. → furnace cooling |

TABLE 2-continued

| Alloy System (Alloy No. of Table 1) | Heat Treatment |
|---|---|
| Ti—6Al—2Sn—4Zr—6Mo (62-67) | 900° C. × 30 min. → air cooling → 600° C. × 6 hr → air cooling |
| Ti—7Al—4Mo (68-70) | 790° C. × 30 min. → furnace cooling |
| Ti—8Al—1V—1Mo (71-73) | 780° C. × 8 hr → air cooling to 480° C. at 55° C./hr → 790° C. × 30 min. → air cooling |
| Ti—6Al—2Sn—4Zr—2Mo (74~77) | 900° C. × 30 min. → air cooling → 788° × 15 min. → air cooling |
| Ti—6Al—2Nb—1Ta—1Mo (78~80) | 800° C. × 30 min. → air cooling |
| Ti—5Al—2.5Sn (81~83) | 750° C. × 30 min. → furnace coolingt |

TABLE 3

| | | Corrosion Test at 250° C. | | Corrosion Test at 300° C. | | Corrosion Test at 250° C. in the presence of S | | Mechanical Properties | | |
|---|---|---|---|---|---|---|---|---|---|---|
| Alloy No. | | Corrosion Rate (mm/year) | Crack | Corrosion Rate (mm/year) | Crack | Corrosion Rate (mm/year) | Crack | Tensile Strength (kgf/mm$^2$) | 0.2% Offset Strength (kgf/mm$^2$) | Elongation (%) |
| Comparative | 1 | 5.1 | None | 8.5 | None | 12.2 | None | 103.2 | 91.1 | 15.2 |
| Alloys | 2 | 4.0 | " | 5.2 | " | 10.5 | " | 103.3 | 90.8 | 15.5 |
| | 3 | 3.3 | " | 3.1 | " | 8.4 | " | 103.2 | 91.5 | 15.3 |
| Invention | 4 | 0.20 | " | 0.30 | " | 0.25 | " | 103.3 | 91.3 | 15.0 |
| Alloys | 5 | 0.05 | " | 0.04 | " | 0.06 | " | 103.2 | 91.4 | 15.3 |
| | 6 | 0.02 | " | 0.03 | " | 0.02 | " | 103.2 | 91.2 | 15.1 |
| | 7 | <0.01 | " | <0.01 | " | <0.01 | " | 103.4 | 91.2 | 15.2 |
| | 8 | <0.01 | " | <0.01 | " | <0.01 | " | 103.3 | 91.3 | 14.9 |
| Comparative Alloys | 9 | 3.5 | " | 0.36 | " | 1.25 | " | 103.3 | 91.2 | 15.0 |
| Invention | 10 | 0.25 | " | 0.35 | " | 0.28 | " | 103.5 | 91.3 | 15.2 |
| Alloys | 11 | 0.08 | " | 0.09 | " | 0.10 | " | 103.4 | 91.5 | 15.3 |
| | 12 | 0.03 | " | 0.05 | " | 0.02 | " | 103.1 | 91.3 | 15.0 |
| | 13 | 0.04 | " | 0.03 | " | 0.03 | " | 103.3 | 91.2 | 15.2 |
| | 14 | 0.02 | " | 0.03 | " | 0.03 | " | 103.2 | 91.3 | 15.3 |
| Comparative Alloys | 15 | 4.2 | " | 7.3 | " | 9.92 | " | 103.5 | 91.4 | 15.2 |
| Invention Alloys | 16 | 0.18 | None | 0.25 | None | 0.19 | None | 103.0 | 91.2 | 15.3 |
| Comparative Alloys | 17 | 4.0 | " | 5.3 | " | 8.25 | " | 103.2 | 91.3 | 15.2 |
| Invention | 18 | 0.16 | " | 0.24 | " | 0.18 | " | 103.3 | 91.4 | 15.3 |
| Alloys | 19 | 0.02 | " | 0.02 | " | 0.03 | " | 103.4 | 91.1 | 15.4 |
| Comparative Alloys | 20 | 4.9 | " | 9.3 | " | 13.3 | " | 103.8 | 91.7 | 15.2 |
| Invention Alloys | 21 | 0.11 | " | 0.18 | " | 0.14 | " | 103.7 | 91.6 | 15.2 |
| Comparative Alloys | 22 | 2.0 | " | 5.1 | " | 7.22 | " | 103.2 | 91.2 | 15.0 |
| Invention | 23 | 0.02 | " | 0.03 | " | 0.03 | " | 103.7 | 91.8 | 14.9 |
| Alloys | 24 | 0.04 | " | 0.04 | " | 0.02 | " | 103.5 | 91.5 | 15.1 |
| | 25 | 0.03 | " | 0.02 | " | 0.03 | " | 104.1 | 92.2 | 15.0 |
| Comparative | 26 | 2.9 | " | 3.1 | " | 6.30 | " | 103.2 | 91.2 | 15.2 |
| Alloys | 27 | 3.1 | " | 3.2 | " | 5.90 | " | 103.1 | 91.3 | 15.3 |
| Invention Alloys | 28 | 0.01 | " | 0.01 | " | 0.01 | " | 103.9 | 91.8 | 14.9 |
| Comparative Alloys | 29 | 3.0 | None | 3.0 | None | 5.4 | None | 103.6 | 91.5 | 15.0 |
| Invention | 30 | <0.01 | " | <0.01 | " | <0.01 | " | 103.4 | 91.4 | 15.2 |
| Alloys | 31 | <0.01 | " | <0.01 | " | <0.01 | " | 104.2 | 91.8 | 14.9 |
| | 32 | <0.01 | " | <0.01 | " | <0.01 | " | 104.3 | 92.2 | 14.7 |
| | 33 | <0.01 | " | <0.01 | " | <0.01 | " | 104.1 | 91.2 | 14.6 |
| | 34 | <0.01 | " | <0.01 | " | <0.01 | " | 104.2 | 92.3 | 14.4 |
| Comparative | 35 | 10.5 | " | >40 | " | 11.5 | " | 105.1 | 93.1 | 13.8 |
| Alloys | 36 | 5.3 | " | 9.2 | " | 10.5 | " | 104.5 | 92.5 | 14.2 |
| | 37 | 4.9 | " | 8.8 | " | 9.5 | " | 108.2 | 94.8 | 12.3 |
| Invention | 38 | <0.01 | " | <0.01 | " | <0.01 | " | 103.9 | 92.5 | 14.9 |
| Alloys | 39 | <0.01 | " | <0.01 | " | <0.01 | "104.3 | 92.1 | 13.9 | |
| | 40 | <0.01 | " | <0.01 | " | <0.01 | " | 103.7 | 91.9 | 14.6 |
| | 41 | 0.02 | " | 0.04 | " | 0.02 | " | 103.6 | 91.8 | 14.4 |
| | 42 | <0.01 | " | <0.01 | " | <0.01 | " | 103.7 | 92.1 | 14.9 |
| | 43 | <0.01 | " | <0.01 | " | <0.01 | " | 103.4 | 91.9 | 14.9 |
| | 44 | 0.03 | " | 0.04 | " | 0.03 | " | 103.8 | 91.4 | 15.1 |
| Invention | 45 | <0.01 | None | <0.01 | None | <0.01 | None | 103.5 | 91.4 | 25.3 |
| Alloys | 46 | <0.01 | " | <0.01 | " | <0.01 | " | 103.6 | 91.3 | 25.2 |
| | 47 | 0.02 | " | 0.05 | " | 0.04 | " | 103.8 | 91.3 | 25.1 |
| | 48 | 0.01 | " | 0.03 | " | 0.01 | " | 103.8 | 91.2 | 25.0 |
| | 49 | 0.01 | " | 0.01 | " | 0.01 | " | 103.9 | 91.5 | 25.0 |
| Comparative Alloys | 50 | 5.8 | " | 9.3 | " | 12.5 | " | 112.5 | 105.3 | 21.2 |
| Invention | 51 | 0.25 | " | 0.30 | " | 0.22 | " | 112.3 | 105.1 | 21.5 |
| Alloys | 52 | 0.03 | " | 0.05 | " | 0.05 | " | 112.4 | 105.2 | 21.4 |
| | 53 | <0.01 | " | <0.01 | " | <0.01 | " | 112.4 | 105.1 | 21.6 |
| | 54 | <0.01 | " | <0.01 | " | <0.01 | " | 113.5 | 105.7 | 21.2 |
| | 55 | <0.01 | " | <0.01 | " | <0.01 | " | 113.3 | 105.4 | 21.3 |
| | 56 | <0.01 | " | <0.01 | " | <0.01 | " | 123.7 | 105.6 | 21.1 |

TABLE 3-continued

| Alloy No. | | Corrosion Test at 250° C. Corrosion Rate (mm/year) | Crack | Corrosion Test at 300° C. Corrosion Rate (mm/year) | Crack | Corrosion Test at 250° C. in the presence of S Corrosion Rate (mm/year) | Crack | Mechanical Properties Tensile Strength (kgf/mm²) | 0.2% Offset Strength (kgf/mm²) | Elongation (%) |
|---|---|---|---|---|---|---|---|---|---|---|
| | 57 | 0.01 | " | 0.02 | " | 0.01 | " | 113.8 | 105.7 | 21.0 |
| Comparative Alloys | 58 | 6.1 | " | 8.8 | " | 13.3 | " | 68.1 | 55.3 | 28 |
| Invention | 59 | 0.02 | " | 0.04 | " | 0.02 | " | 68.1 | 55.4 | 27 |
| Alloys 60 | <0.01 | " | <0.01 | " | <0.01 | " | 68.8 | 56.0 | 26 | |
| Invention | 61 | <0.01 | None | <0.01 | None | <0.01 | None | 69.2 | 56.3 | 25 |
| Alloys | | | | | | | | | | |
| Comparative Alloys | 62 | 5.9 | " | 8.6 | " | 11.3 | " | 130.1 | 114.2 | 14.2 |
| Invention | 63 | 0.11 | " | 0.21 | " | 0.15 | " | 130.2 | 113.8 | 14.3 |
| Alloys | 64 | <0.01 | " | <0.01 | " | <0.01 | " | 132.5 | 114.1 | 14.5 |
| | 65 | <0.01 | " | <0.01 | " | <0.01 | " | 133.2 | 114.6 | 13.7 |
| | 66 | <0.01 | " | <0.01 | " | <0.01 | " | 132.2 | 113.8 | 13.9 |
| | 67 | 0.02 | " | 0.03 | " | 0.02 | " | 130.6 | 114.4 | 13.1 |
| Comparative Alloys | 68 | 5.7 | " | 8.6 | " | 10.3 | " | 108.6 | 101.5 | 14.7 |
| Invention | 69 | <0.01 | " | <0.01 | " | <0.01 | " | 109.1 101.7 | 14.5 | |
| Alloys | 70 | 0.03 | " | 0.02 | " | 0.02 | " | 108.4 | 101.2 | 14.8 |
| Comparative Alloys | 71 | 5.4 | " | 9.1 | " | 17.8 | " | 101.7 | 97.1 | 15.6 |
| Invention | 72 | <0.01 | " | <0.01 | " | <0.01 | " | 103.1 | 97.5 | 14.3 |
| Alloys | 73 | 0.02 | " | 0.03 | " | 0.05 | " | 101.6 | 96.8 | 15.5 |
| Comparative Alloys | 74 | 5.8 | " | 9.0 | " | 14.1 | " | 100.5 | 91.2 | 15.4 |
| Invention | 75 | <0.01 | None | <0.01 | None | <0.01 | None | 101.8 | 91.8 | 14.9 |
| Alloys | 76 | 0.04 | " | 0.05 | " | 0.02 | " | 101.1 | 90.7 | 15.2 |
| | 77 | 0.02 | " | 0.03 | " | 0.04 | " | 102.3 | 92.1 | 14.6 |
| Comparative Alloys | 78 | 4.9 | " | 8.5 | " | 14.1 | " | 102.2 | 94.7 | 15.2 |
| Invention | 79 | <0.01 | " | <0.01 | " | <0.01 | " | 102.8 | 94.4 | 14.8 |
| Alloys | 80 | 0.03 | " | 0.04 | " | 0.03 | " | 102.3 | 94.5 | 15.0 |
| Comparative Alloys | 81 | 5.9 | " | 8.9 | " | 13.6 | " | 95.0 | 84.2 | 18.0 |
| Invention | 82 | <0.01 | " | <0.01 | " | <0.01 | " | 96.2 | 84.7 | 17.5 |
| Alloys | 83 | 0.01 | " | 0.02 | " | 0.02 | " | 95.1 | 83.7 | 18.3 |
| Comparative Alloys | 84 | 0.01 | " | 0.4 | " | 2.15 | Occurred | 85.6 | 39.0 | 55.8 |
| | 85 | 0.5 | Occurred | 1.2 | Occurred | 5.12 | " | 125.3 | 84.0 | 24.0 |

What is claimed is:

1. In a deep well environment wherein $\alpha$-type or $(\beta+\beta)$-type Ti-based alloys parts are subjected to corrosive media containing carbon dioxide, chloride ions and wet hydrogen sulfide under high pressure at high temperature wherein corrosive resistance of said parts is improved by adding 0.02–0.2 weight % of at least one platinum group metal as an alloying agent therein.

2. In the deep well environment of claim 1, in which the platinum group metal is selected from the group consisting of Pd and Ru.

3. In the deep well environment of claim 2, in which the Ti-based alloy is of the $(\alpha+\beta)$ type.

4. A method as defined in claim 2, in which the platinum group metal is Pd.

5. A method as defined in claim 3, in which the $(\alpha+\beta)$-type Ti-based alloy is selected from Ti-6Al-4V, Ti-6Al-2Sn-4Zr-2Mo, and Ti-6Al-2Sn-4Zr-6Mo.

6. In a deep well environment wherein $\alpha$-type or $(\alpha+\beta)$-type Ti-based alloys parts are subjected to corrosive media containing carbon dioxide, chloride ions and wet hydrogen sulfide under high pressure at high temperature wherein corrosion resistance of said parts is improved by adding at least one platinum group metal in the amount of 0.005–0.12% by weight and at least one of Ni, Co, W, and Mo in the amount of 0.05–2.00% by weight.

7. In the deep well environment of claim 6, in which the platinum group metal is selected from the group consisting of Pd and Ru.

8. In the deep well environment of claim 6, in which at least one of Ni and Co is added in a total amount of 0.05–2.00% by weight.

9. In the deep well environment of claim 6, in which at least one of W and Mo is added in a total amount of 0.05–2.00% by weight.

10. In the deep well environment of claim 6, in which the Ti-based alloy is of the $(\alpha+\beta)$ type.

11. A method as defined in claim 7, in which the platinum group metal is Pd.

12. A method as defined in claim 10, in which the $(\alpha+\beta)$-type Ti-based alloy is selected from Ti-6Al-4V, Ti-6Al-2Sn-4Zr-Mo, and Ti-6Al-2Sn-4Zr-6Mo.

13. In a deep well environment wherein $\alpha$-type or $(\alpha+\beta)$-type Ti-based alloys parts are subjected to corrosive media containing carbon dioxide, chloride ions and wet hydrogen sulfide under high pressure at high temperature wherein corrosion resistance of said parts is improved by adding as an alloying element, (A) at least one platinum group metal in an amount of 0.02–0.20% by weight, or (B) at least one platinum group metal in an amount of 0.005–0.12% by weight and at least one of Ni, CO, W, and Mo in an amount of 0.05–2.00% by weight.

14. In the deep well environment by claim 13, in which the oil-well tubular products are selected from tubing, casing, drill pipes, and housings for oil-well loggers.

15. In the deep well environment by claim 13, in which the oil-well environment is at around 300° C.

16. In the deep well environment of claim 13, in which the deep-well environment contains elemental sulfur at around 250° C.

17. In the deep well environment of claim 13, in which the platinum group metal is selected from the group consisting of Pd and Ru.

18. In the deep well environment of claim 13, in which the platinum group metal is Pd.

19. In the deep well environment of claim 13, in which at least one of Ni and Co is added in a total amount of 0.05–2.00% by weight.

20. In the deep well environment of claim 13, in which at least one of W and Mo is added in a total amount of 0.05–2.00% by weight.

21. In the deep well environment of claim 13, in which the Ti-based alloy is of the $(\alpha+\beta)$ type including Ti-6Al-4V, Ti-6Al-2Sn-4Zr-2Mo, and Ti-6Al-2Sn-4Zr-6Mo.

* * * * *